US012527377B2

(12) United States Patent
Heinemark et al.

(10) Patent No.: US 12,527,377 B2
(45) Date of Patent: Jan. 20, 2026

(54) REINFORCED FACE PROTECTION ACCESSORIES FOR HARD HATS

(71) Applicant: HUSQVARNA AB, Huskvarna (SE)

(72) Inventors: Carl Heinemark, Tenhult (SE); Mikael Arvidsson, Jonkoping (SE); Mats Lawenius, Gothenburg (SE); Daniel Lovenback, Sollebrunn (SE); Guillaume Descamps, Stockholm (SE); Gustav Landberg, Trosa (SE)

(73) Assignee: HUSQVARNA AB, Huskvarna (SE)

( * ) Notice: Subject to any disclaimer, the term of this patent is extended or adjusted under 35 U.S.C. 154(b) by 0 days.

(21) Appl. No.: 18/710,442

(22) PCT Filed: Nov. 18, 2022

(86) PCT No.: PCT/SE2022/051077
§ 371 (c)(1),
(2) Date: May 15, 2024

(87) PCT Pub. No.: WO2023/091072
PCT Pub. Date: May 25, 2023

(65) Prior Publication Data

US 2025/0000196 A1 Jan. 2, 2025

(30) Foreign Application Priority Data

Nov. 18, 2021 (SE) ..... 2151404-7
Nov. 18, 2021 (SE) ..... 2151405-4

(51) Int. Cl.
*A42B 3/22* (2006.01)
*A42B 3/20* (2006.01)

(52) U.S. Cl.
CPC ..... *A42B 3/225* (2013.01); *A42B 3/205* (2013.01); *A42B 3/222* (2013.01)

(58) Field of Classification Search
CPC .. A42B 3/20; A42B 3/205; A42B 3/18; A42B 3/22; A42B 3/221; A42B 3/222; A42B 3/223; A42B 3/225
See application file for complete search history.

(56) References Cited

U.S. PATENT DOCUMENTS 2,204,688 A 6/1940 William et al.
2,790,175 A 4/1957 Sowle
(Continued)

FOREIGN PATENT DOCUMENTS

AU 2002100570 A4 11/2002
CA 2201973 A1 10/1998
(Continued)

OTHER PUBLICATIONS

International Search Report and Written Opinion for PCT Application No. PCT/SE2022/051077, dated Feb. 10, 2023.
(Continued)

*Primary Examiner* — Khoa D Huynh
*Assistant Examiner* — Erick I Lopez
(74) *Attorney, Agent, or Firm* — Burr & Forman

(57) ABSTRACT

A face protection accessory (110) for assembly with a protective helmet (100) to protect a wearer (300) during a cut-off tool kickback event, wherein the accessory (110) comprises a U-shaped supporting frame (115) extending between left and right temple anchoring points (120*l*, 120*r*), via left and right check-bone portions (130*l*, 130*r*) arranged on either side of the U-shaped supporting frame (115), and a chin portion (140) arranged at a distal end of the accessory (110), where the temple anchoring points (120*l*, 120*r*) are configured to attach to the protective helmet (100), and wherein at least a first guard bar (150) extends transversal to the U-shaped supporting frame (115) between the left and the right check-bone portions (130*l*, 130*r*).

17 Claims, 6 Drawing Sheets

(56) References Cited

U.S. PATENT DOCUMENTS

| | | | | |
|---|---|---|---|---|
| 2,850,740 | A | 9/1958 | Adams | |
| 2,881,442 | A | 4/1959 | Sowle | |
| 2,908,911 | A | 10/1959 | Sowle | |
| 3,274,613 | A | 9/1966 | Sowle | |
| 3,984,875 | A | 10/1976 | Farquharson | |
| 4,021,858 | A * | 5/1977 | Neeld | A42B 3/08 2/9 |
| 4,097,929 | A | 7/1978 | Lowe et al. | |
| 4,271,537 | A | 6/1981 | Bowlus et al. | |
| 4,370,759 | A | 2/1983 | Zide | |
| 4,495,657 | A | 1/1985 | Bay | |
| 4,713,844 | A | 12/1987 | Westgate | |
| 4,885,806 | A | 12/1989 | Heller | |
| 5,263,204 | A | 11/1993 | Butsch | |
| 5,477,565 | A | 12/1995 | Hunt, Jr. | |
| 5,483,699 | A | 1/1996 | Pernicka et al. | |
| 6,035,451 | A | 3/2000 | Burns et al. | |
| 6,189,156 | B1 | 2/2001 | Loiars | |
| 6,301,719 | B1 | 10/2001 | Goodhand et al. | |
| 6,598,234 | B1 | 7/2003 | Brown et al. | |
| 6,834,398 | B1 | 12/2004 | Martinez | |
| 6,978,477 | B2 | 12/2005 | Foote | |
| 7,430,763 | B1 | 10/2008 | Santos | |
| 7,805,776 | B2 | 10/2010 | Crossman et al. | |
| 8,166,575 | B2 | 5/2012 | Haselmayer | |
| 8,225,421 | B1 | 7/2012 | Froissard | |
| 8,336,123 | B2 | 12/2012 | Gleason et al. | |
| 9,072,332 | B2 | 7/2015 | De Harde et al. | |
| 9,314,060 | B2 | 4/2016 | Giles | |
| 9,700,096 | B2 | 7/2017 | Mcginn et al. | |
| 9,788,593 | B2 | 10/2017 | Lebel et al. | |
| 9,848,667 | B2 | 12/2017 | Brace et al. | |
| 10,165,819 | B2 | 1/2019 | Klotz et al. | |
| 10,219,579 | B2 | 3/2019 | Gotti | |
| 11,000,754 | B2 | 5/2021 | Gotti | |
| 11,006,689 | B1 | 5/2021 | Nowak et al. | |
| 2004/0199982 | A1 | 10/2004 | Wang-Lee | |
| 2009/0044316 | A1 * | 2/2009 | Udelhofen | A63B 71/10 2/9 |
| 2010/0122402 | A1 | 5/2010 | Tipp | |
| 2010/0132095 | A1 | 6/2010 | Gafforio et al. | |
| 2012/0246807 | A1 | 10/2012 | Klotz et al. | |
| 2014/0053307 | A1 | 2/2014 | Cheng | |
| 2014/0259310 | A1 | 9/2014 | Ricket et al. | |
| 2016/0183622 | A1 | 6/2016 | Patel et al. | |
| 2017/0042273 | A1 | 2/2017 | Fletcher et al. | |
| 2017/0112224 | A1 | 4/2017 | Gotti | |
| 2017/0112227 | A1 | 4/2017 | Pietrzak et al. | |
| 2017/0188646 | A1 | 7/2017 | Liang | |
| 2018/0084848 | A1 | 3/2018 | Pavalarajan et al. | |
| 2018/0092426 | A1 | 4/2018 | Hall et al. | |
| 2018/0249779 | A1 | 9/2018 | Delima et al. | |
| 2019/0075879 | A1 | 3/2019 | Persson et al. | |
| 2019/0104800 | A1 | 4/2019 | Schuster et al. | |
| 2019/0274390 | A1 | 9/2019 | Veronese et al. | |
| 2021/0282476 | A1 | 9/2021 | Memita | |
| 2022/0047030 | A1 * | 2/2022 | Summersett | A42B 3/0406 |

FOREIGN PATENT DOCUMENTS

| | | | |
|---|---|---|---|
| CN | 109892738 | A | 6/2019 |
| DE | 2853260 | A1 | 6/1980 |
| DE | 8633539 | U1 | 4/1987 |
| DE | 29917396 | U1 | 2/2000 |
| DE | 20205180 | U1 | 7/2002 |
| DE | 10108458 | A1 | 9/2002 |
| DE | 102005006078 | A1 | 3/2006 |
| DE | 202020102502 | U1 | 7/2020 |
| EP | 0741527 | A1 | 11/1996 |
| EP | 1740066 | B1 | 10/2008 |
| EP | 3162236 | B1 | 3/2019 |
| EP | 3435804 | B1 | 9/2019 |
| EP | 3626098 | A1 | 3/2020 |
| GB | 2529841 | A | 3/2016 |
| GB | 2531693 | A | 5/2016 |
| GB | 2535639 | A | 8/2016 |
| GB | 2542429 | A | 3/2017 |
| KR | 102266915 | B1 | 6/2021 |
| WO | 2005115188 | A1 | 12/2005 |
| WO | 2018055087 | A1 | 3/2018 |
| WO | 2019122498 | A1 | 6/2019 |
| WO | 2019167097 | A1 | 9/2019 |

OTHER PUBLICATIONS

Swedish Search Report & Office Action for Swedish patent application No. 2151404-7, dated May 12, 2022.

Swedish Search Report & Office Action for Swedish patent application No. 2151405-4, dated May 12, 2022.

* cited by examiner

REINFORCED FACE PROTECTION ACCESSORIES FOR HARD HATS

TECHNICAL FIELD

The present disclosure relates to construction equipment and in particular to a protective helmet suitable for use on construction sites, such as a hard hat, comprising a face protection accessory configured to protect a user in case of a cut-off tool kickback event.

BACKGROUND

Cut-off tools for processing hard materials such as concrete and stone require powerful motors which provide the necessary energy to process the hard materials. On rare occasions, the rotating cutting disc of the cut-off tool enters into locking contact with the object that is processed. Due to the large amounts of kinetic energy stored in the rapidly rotating cutting disc and associated machine parts, the disc will be ejected from the object and the cut-off tool will move upwards and backwards towards the operator. This is referred to as a kickback condition, and it may cause severe injury to the operator. It is therefore highly desirable to avoid kickback events, and to mitigate the effects of a kickback event if it should anyway occur.

U.S. Pat. No. 11,006,689 B1 describes a protective helmet with a face protection mask. The face protection mask is configured for releasable attachment to the protective helmet by a loop through which at least a portion of the dome of the protective helmet can pass in order to suspend the face protection device from the hard hat. A visor can optionally be placed inboard of the mask. The described face protection mask is relatively bulky and does not appear suitable for protecting an operator in the event of a kickback event.

US 2017/0112224 A1 discloses a face protection accessory for a hard hat. The accessory comprises a support structure which is configured to releasably engage the helmet, and to support a see-though face protection device such as a transparent or perforated face shield. The described face protection accessories appear to be primarily intended for protection against spray, dust and small debris, and not for protecting an operator in the event of a kickback event.

- WO 2018/055087 A1 describes a sports helmet with a releasable face guard.
- WO 2005/115188 A1 describes a safety helmet with a see-though visor.
- US 2012/0246807 A1 shows a protective helmet with integrated hearing protection.
- US 2009/0044316 A1 discloses a sports helmet with a removable facemask.

Still, there is a continuing need for improved kickback protection equipment.

SUMMARY

It is an object of the present disclosure to provide protective helmets and accessories for protective helmets suitable for use on construction sites which provide sufficient protection for a wearer in case of a kickback event, and at the same time protects the wearer from falling objects and the like.

This object is at least in part obtained by a face protection accessory for assembly with a protective helmet dimensioned to protect a wearer during a cut-off tool kickback event. The accessory comprises a U-shaped supporting frame extending between left and right temple anchoring points via left and right cheek-bone portions arranged on either side of the U-shaped supporting frame, and a chin portion arranged at a distal end of the accessory. The left and right temple anchoring points are configured for attachment to the protective helmet. At least a first guard bar extends transversal to the U-shaped supporting frame between the left and the right cheek-bone portions. This face protection accessory can be assembled with a hard hat by attachment at the anchoring points. The guard bar and the U-shaped supporting frame together provide sufficient protection for a wearer in case of a kickback event. The face protection accessory does not add significant weight to the protective helmet, or make the helmet uncomfortable to wear, which is an advantage. The U-shaped supporting frame is optionally formed in a plastic material which is of light weight, and yet strong enough to provide sufficient protection during a kickback event. The guard bar is preferably a rigid steel bar.

The face protection accessory optionally also comprises a visor supporting frame extending between the left and right temple anchoring points. The visor supporting frame is configured to hold a visor which provides extra protection for the eyes of a wearer. The U-shaped supporting frame preferably has a portion with a shape complementary to the visor supporting frame, allowing the U-shaped supporting frame to cooperate with the visor supporting frame without mutual interference, which is an advantage. The complementary shape allows the visor to be operated independently of the rest of the face protection accessory.

According to aspects, the visor supporting frame is arranged to be pivotably attached to an exterior surface of the protective helmet. The position on the exterior surface of the helmet allows the visor to pivot without interfering with the fixed U-shaped supporting frame, which is preferably attached at the interior surface of the protective helmet. The mutually opposite surface engagement of the visor supporting frame and the U-shaped supporting frame provide increased strength to the overall face protection accessory.

According to aspects, the left and right temple anchoring points comprise respective supporting surfaces matched to corresponding supporting surfaces of the protective helmet, and fastening members arranged extending through the helmet, to fixedly secure the face protection accessory to the protective helmet. The supporting surfaces provide an increased strength at the attachment point between the U-shaped supporting frame and the protective helmet since forces are distributed more equally over the supporting surface. It is an advantage that the supporting surfaces can be matched to almost any type of protective helmet, thus enabling retro-fitting of the face protection accessory to existing helmets as well as new helmet designs not yet on the market.

According to aspects, the first guard bar is a metal guard bar having a cross section diameter of at least 2 mm, and preferably between 3-6 mm or 4-6 mm, such as about 5 mm. This dimension of the guard bar provides sufficient strength, and still does not add too much weight to the face protection accessory to make it uncomfortable to wear.

According to aspects, the protective helmet extends in a dome shape from a base plane and the first guard bar extends away from the U-shaped supporting frame such that an extreme point of the first guard bar extends beyond a plane orthogonal to the base plane and tangent to a brim portion of the protective helmet or at least intersecting the dome shaped shell of the helmet. Thus, the first guard bar is arranged distanced from the helmet in a pointing direction of the nose of the wearer. Since the guard bar projects out from the face of the wearer, there is a buffer distance between the wearer and the guard bar which provides a safety distance to a cutting blade during a kickback event.

According to aspects, the U-shaped supporting frame is configured to provide a spacing distance from the wearer to the left and right cheek-bone portions. This space increases the comfort of wearing the helmet and improves ventilation. Still, in case of a kickback event, the U-shaped supporting frame lands on the wearer where the impact energy is distributed by the U-shaped supporting frame to mitigate the consequences of the kickback. The spacing distance from the wearer to the left and right cheek-bone portions may be about 0.5-2 cm. Similarly, the U-shaped supporting frame can be configured to provide a spacing distance from the wearer to the chin portion. The spacing distance from the wearer to the chin portion may be on the order of 1-5 cm, i.e., slightly larger compared to the spacing distance from the wearer to the left and right cheek-bone portions.

According to aspects, a guard bar support member extends out from the chin portion to support the first guard bar. This guard bar support member provides additional mechanical strength to the first guard bar which is an advantage.

The guard bar support member also provides additional protection around an area of the mouth of a wearer, which is an advantage. Still, thanks to the preferred distance to the wearer from the guard bar support member, there is room for, e.g., a respiratory protection device and the distance to the wearer also decreases the discomfort of wearing the helmet.

According to aspects, the supporting surfaces of the left and right temple anchoring points are arranged to engage respective supporting surfaces of the protective helmet on an interior surface of the helmet. It is an advantage that the supporting surfaces engages the interior of the helmet, since this increases the mechanical strength of the assembly and makes room for additional accessories to be mounted on the exterior surface of the helmet, such as a visor supporting frame or hearing protection devices.

According to aspects, a second guard bar extends in alignment with and distanced from the first guard bar, transversal to the U-shaped supporting frame between the left and the right cheek-bone portions. This second guard bar may advantageously be formed in metal, preferably of the same dimensions as the first guard bar. The second guard bar provides additional shielding for the face of the wearer, thereby improving the protection in case kickback occurs.

According to aspects, one or more shock absorbing elements are arranged on a surface of the U-shaped supporting frame arranged to face the wearer. The shock absorbing elements help to absorb at least some of the impact energy during a kickback event, which is an advantage. The shock absorbing elements also improve the distribution of the impact energy over the face of the wearer, thereby mitigating the consequences of the kickback event. The shock absorbing elements are preferably formed in a resilient material, such as rubber or a resilient plastic or polymer foam material. Each cheek-bone portion optionally comprises a respective resilient shock absorbing element arranged on a side of the cheek-bone portion configured to face the corresponding cheek bone of the wearer. Thus, impact energy directed towards the chin portion is partly absorbed by the shock absorbing element arranged on the cheek-bone portion, and the shock absorbing material also help to distribute the impact energy over a larger surface of the face of the wearer, which is an advantage. The chin portion may also comprise a shock absorbing element on a side of the chin portion configured to face the chin of the wearer, with similar technical effect as the shock absorbing element on the cheek-bone portion.

According to aspects, the U-shaped supporting frame is separable by means of releasable attachments arranged at a location between the cheek-bone portions and the temple anchoring points of the U-shaped supporting frame. This means that a part of the U-shaped supporting frame (the part comprising the guard bar or guard bars) can be removed from the helmet without releasing the connection at the temple anchoring points. Thus, the face protection accessory can be attached to and removed from the helmet as needed in a convenient manner.

According to aspects, the releasable attachments between the temple anchoring points and respective left and right cheek-bone portions comprise snap-lock mechanisms or interference fit mechanisms. Both snap-lock mechanisms and interference fit mechanisms provide convenient means for attaching and removing the face protection accessory from the protective helmet.

According to aspects, the U-shaped supporting frame comprises attachment means for a chin strap. The efficiency of the chin-strap in providing protection during a kick-back event can be improved compared to if the chin strap only attaches to the protective helmet, since the U-shaped supporting frame offers better geometry, e.g., allowing attachment close to the chin of the wearer.

According to aspects, the first guard bar and/or the second guard bar is an over-molded steel rod arranged inserted into the U-shaped supporting frame. The steel rod improves the overall strength of the face protection accessory, and by over-molding it the attachment between guard bar and the U-shaped supporting frame is improved.

According to aspects, the visor supporting frame is arranged outboard of the U-shaped supporting frame with respect to the protective helmet. This is an advantage since the visor supporting frame can then pivot freely without interfering with the U-shaped supporting frame. I.e. the visor supporting frame can be arranged pivotably attached to the U-shaped supporting frame and/or to the protective helmet and configured to pivot about the temple anchoring points without interfering with the U-shaped supporting frame. The visor supporting frame can be arranged to pivot in an arc past the first and/or second guard bar. This means that the visor can assume a position close to the eyes of the wearer, improving the protection against dust and debris, while the guard bars still extend out from the face of the wearer to provide the protective buffer distance which is wanted in case of a kickback event. Consequently, the visor supporting frame is arranged to cooperate with the fixed U-shaped supporting frame in an advantageous manner.

According to aspects, the visor supporting frame is arranged to receive a visor and to releasably hold the visor in position by first and second snap-lock mechanisms and/or interference fit mechanisms on either side of the visor. This way the visor can be replaced in a convenient manner, for instance if it gets scratched or dirty, or if some other visor type of desired. For instance, a user may wish to replace a see-though glass visor by a mesh or other form of protective visor device.

According to aspects, the snap-lock mechanisms comprise respective protrusions formed on an inboard surface of the visor supporting frame, with a matching hole formed in a tab portion of the visor for engaging the protrusion in locking position. In this manner the visor is securely held in the visor supporting frame, which is an advantage.

According to aspects, the visor supporting frame is arranged to receive a visor, and to releasably hold the visor in position by a central guiding member comprising a protrusion and a matching recess configured to receive the protrusion in guiding position. The central guiding member increases the strength of the bond between visor and visor supporting frame. The central guiding member also improves the rigidity of the visor when received in the visor supporting frame.

According to aspects, the visor supporting frame is arranged to at least partly enclose a tab portion of the visor. The tab portion enters into the visor supporting frame whereby the bond between visor and visor supporting frame is increased.

According to aspects, the visor supporting frame comprises a first reinforcement structure configured in connection to a brim section of the visor supporting frame. The reinforcement structure provides even more protection for a wearer in case of kickback, which is an advantage. The first reinforcement structure may, e.g., comprise a steel bar embedded into or attached to the brim section of the visor supporting frame.

According to aspects, the U-shaped supporting frame comprises a second reinforcement structure configured in connection to the chin portion of the U-shaped supporting frame. Like the brim portion reinforcement structure, the cheek portion reinforcement structure increases the strength of the face protection accessory in vicinity of the chin portion, thereby further improving the protection for the wearer in case of kickback. Just like the first reinforcement structure, the second reinforcement structure may comprise a steel bar embedded into or attached outboard of the chin portion of the U-shaped supporting frame.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated. Further features of, and advantages with, the present invention will become apparent when studying the appended claims and the following description. The skilled person realizes that different features of the present invention may be combined to create embodiments other than those described in the following, without departing from the scope of the present invention.

BRIEF DESCRIPTION OF THE DRAWINGS

The present disclosure will now be described in more detail with reference to the appended drawings, where.

DETAILED DESCRIPTION

Figure 1:
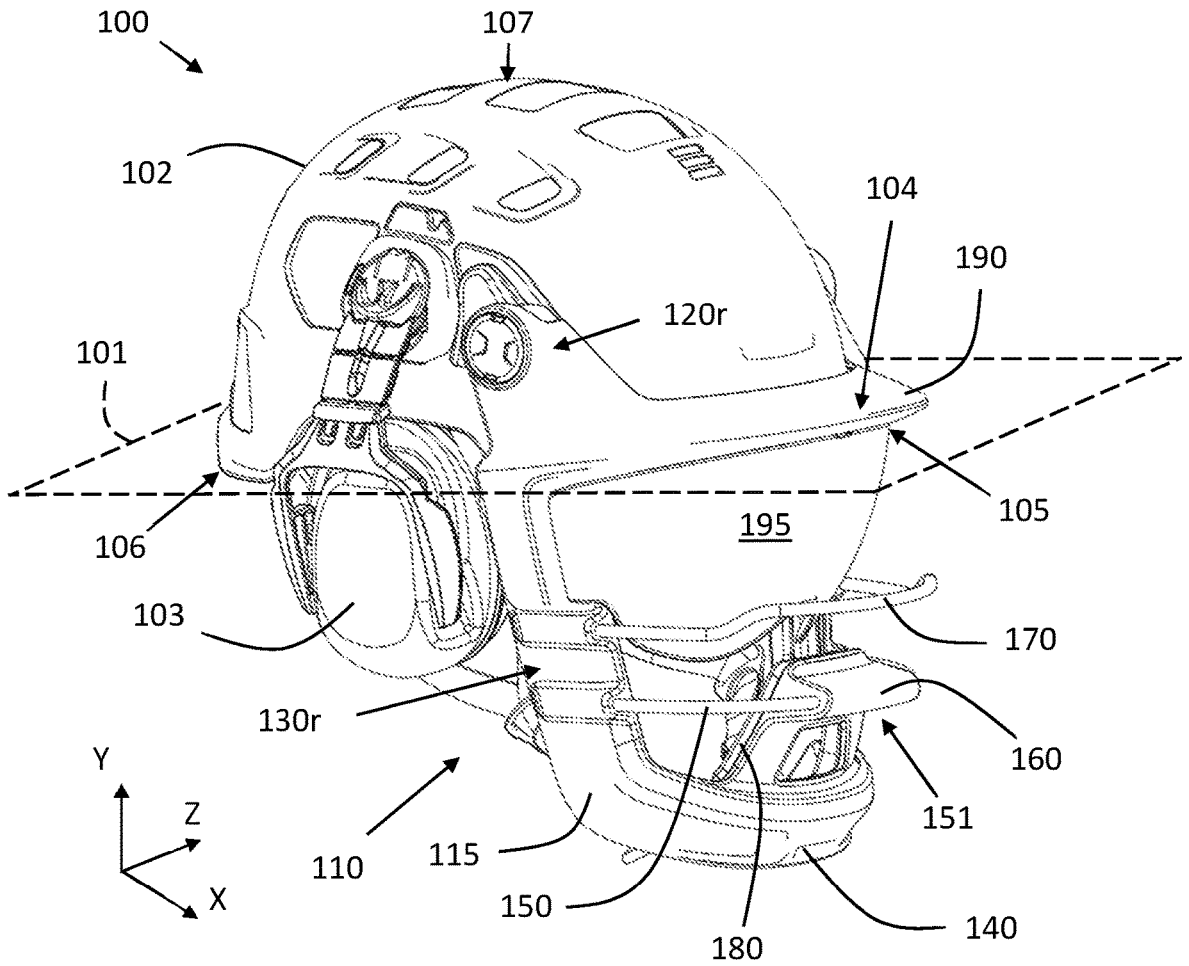
FIG. 1 shows a protective helmet with a face protection accessory, FIG. 2 schematically illustrates a U-shaped supporting frame.

The invention will now be described more fully hereinafter with reference to the accompanying drawings, in which certain aspects of the invention are shown. This invention may, however, be embodied in many different forms and should not be construed as limited to the embodiments and aspects set forth herein; rather, these embodiments are provided by way of example so that this disclosure will be thorough and complete, and will fully convey the scope of the invention to those skilled in the art. Like numbers refer to like elements throughout the description.

It is to be understood that the present invention is not limited to the embodiments described herein and illustrated in the drawings; rather, the skilled person will recognize that many changes and modifications may be made within the scope of the appended claims.

Construction workers are normally required to wear some form of industrial protective helmet, often referred to as a hard hat. Industrial safety helmets must be designed for long working days, and for usage in hot environments on top of that. This calls for light weight solutions as well as solutions with sufficient ventilation and minimal contact zones against the wearer for ergonomic purposes. The standard hard hat helmet type is mainly designed to protect the user from obstacles falling from above and from lighter bumps from around its sides which is why it is allowed to sit more on top of the head, rather than surrounding the whole head as, e.g., a motorcycle helmet does. In a stability and coverage perspective, it does not have to be designed with a shell that extends past the ears or down to the neck on the backside. Rather, the industrial safety helmet shell must leave room around the ear for hearing protection. A standard hard hat, such as that illustrated in US 2017/0112224 A1, does not offer sufficient protection for a user in the event of a kickback event.

There are helmets that do offer reliable face protection, such as motorcycle helmets and some types of sports helmets. These helmets have a lot more rotational stability than that of industrial hard hat type helmets due to a larger coverage area of the head and more padding with direct contact with the head of the person wearing the helmet. This stability is needed for the activities the helmet is intended for, but is also an important factor for the ability of the face protection arrangement to transfer the energy of an impact to the helmet and to distribute the forces over as much body area as possible. The possibility of integrating the face protection around the center of the head, with multiple attachment points (depending on type), increases the mechanical integrity and strength of the product.

The shell or outer surface of industrial protective helmets normally do not extend below the wearer's ear, to allow for ear muffs or other forms of hearing protection, which renders the integration of a face protection accessory troublesome. To fully cover the face all the way down to the wearers chin, which is likely to be the most exposed part of the face in event of a kickback, with sufficient protection from a cut-off tool blade, the face protection accessory must extend a long way from its anchor points. Because of the long distance from the anchor points of the face protection accessory on the protective helmet to the likely location of the force it is subjected to during a kickback event, it must be designed with strong and stiff geometries since they would otherwise flex and land directly in the wearer's face without reducing much energy of the impact. However, a stiff protection design will in turn lead to anchor points being subjected to great torque. Even with a well-functioning and firm attachment, given the limitations for industrial safety helmet's resistance to rotation, the impact will cause a rotating motion of the complete helmet around the head of the wearer. This pushes down the helmet brim towards the wearer's eyes and transports the lower part of the face protection downwards and towards the face which still allows the cut-off tool blade to come dangerously close to the face of the wearer during a kickback event cutting blade impact. Adding a chin strap to the helmet's retention system will to a certain extent reduce the rotation and a neckband will stretch and therefore also absorb some of the energy at impact. However, even with these improvements, an impact energy of about 75 joules commonly experienced during a kickback event (for some example machines and cutting tools) is often too much for the protective systems on known construction site helmets to handle.

FIG. 1 illustrates a protective helmet 100 which comprises at least some of the features discussed above. This example is built around a hard hat-like protective helmet structure, having a dome-shaped shell 102 extending from a base plane 101. The base plane 101 intersects a bottom part of the helmet, and/or is tangent to the lower extreme points of the helmet when the helmet is in a normal upright resting position on the head of a user, e.g., as exemplified in FIG. 3. On many protective helmets, the base plane 101 is parallel or at least approximately parallel with the horizontal plane when worn by a wearer in a normal standing posture. For most helmet types, the base plane 101 forms a bottom surface of a minimum bounding box of the protective helmet without any mounted accessories such as hearing protection and face protection accessories. Thus, it is appreciated that the base plane 101 can be defined in at least three ways, and that the base plane 101 may look different from helmet to helmet.

The protective helmet 100 comprises a brim portion 104 as indicated in FIG. 1, which is the front part of the dome-shaped shell 102 just above the eyes of the wearer. The brim portion may on some helmets be somewhat protruding, e.g., to form a sunscreen as shown in FIG. 1. The brim portion 104 may also be referred to as a helmet cap. According to a preferred embodiment, the base plane 101 extends from the lower edge 105 of the brim portion 104 (or helmet cap) to the lower edge of the rear helmet portion 106, forming the bottom face of the above-mentioned bounding box. As will be discussed in more detail below, the face protection accessory 110 comprises a U-shaped supporting frame 115 which extends between left and right temple anchoring points **120*l*, 120*r*. These anchoring points are preferably arranged above the base plane 101 some distance up on the dome-shaped shell 102 towards the apex 107 of the dome-shaped shell 102, as illustrated in FIG. 1. The anchoring points are called temple anchoring points since the are located close to the temples of a wearer of the helmet in use. The anchoring points 120*l*, 120*r* may be located one centimeter or more above the base plane 101**.

Another way to describe this feature is that the base plane 101 of the protective helmet 100 extends from a lower edge 105 of the brim portion 104 of the helmet 100 to a lower edge 106 of the rear portion of the helmet 100 in use, where a normal to the base plane 101 intersects the apex 107 of the dome-shaped shell 102, and where the left and right temple anchoring points **120*l*, 120*r* are separated from the chin portion 140 by the base plane 101**.

By anchoring the U-shaped supporting frame 115 above the base plane 101 in this manner, and not below the base plane closer to the chins of the wearer, such as in vicinity of the ears of a wearer, an improved behavior of the face protection accessory 110 in the event of a kickback event is obtained. Another advantage of anchoring the U-shaped supporting frame 115 above the base plane 101 is that hearing protection can be more efficiently accommodated, as illustrated in FIG. 1.

WO 2018/055087 describes a helmet that comprises a face protection arrangement which, at first glance, appears similar to the face protection arrangement described herein and illustrated in the drawings. However, the face protection arrangement in WO 2018/055087 is attached below the base plane 101 of the helmet at a distance from the base plane 101, and therefore not as suitable for protecting a user in the event of kickback. The anchoring points described in WO 2018/055087 are not temple anchoring points since the anchoring points are distanced from the temples of a wearer in use.

The anchoring points of the face protection arrangement in WO 2018/055087 are integrated with an ear piece having an opening, i.e., occupy the location where hearing protection is best mounted, which is a drawback.

It is appreciated that the face protection accessories discussed herein are applicable also together with other types of protective helmets. In fact, one of the main advantages with the helmet accessories proposed herein is that they can be adapted for use with almost any type of construction site helmet.

When discussing protective helmets like the hard hat in FIG. 1, a coordinate system will be used where a first axis (referred to as the x-axis in FIG. 1) extends in the base plane 101 of the helmet from a back of the helmet to a front of the helmet, i.e., towards the brim of the helmet. A second axis of the helmet (referred to as the y-axis in FIG. 1) is normal to the base plane 101, while a third axis (referred to as the z-axis in FIG. 1) is orthogonal to the first and the second axes, i.e., extending from one side of the helmet to the other side along the base plane 101. In other words, the y-axis extends vertically in a normal upright rest position when the helmet is worn by a user. The z-axis extends horizontally from one side of the helmet to the other side of the helmet. The x-axis is orthogonal to both the z-axis and the y-axis, extending horizontally from a back portion of the helmet to a front portion of the helmet.

The helmet illustrated in FIG. 1 comprises optional integrated hearing protection 103. It is noted that the face protection accessories discussed herein are compatible with such integrated hearing protection, which is an advantage. In fact, one advantageous feature of the example helmet 100 shown in FIG. 1 is that the face protection accessory does not interfere with the operation and function of the hearing protection 103, and vice versa.

Figure 2:
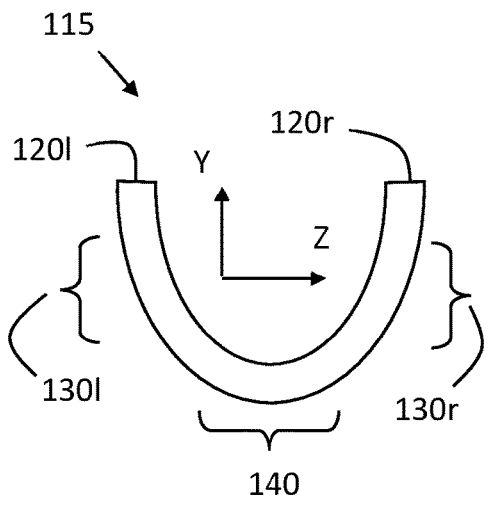
Figure 3:
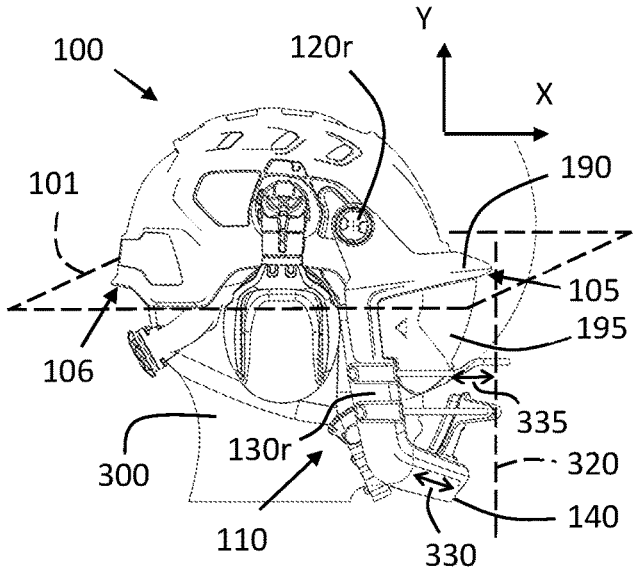
FIG. 3 illustrates a person wearing a protective helmet.

With reference also to FIG. 2 and to FIG. 3, the present disclosure relates to a face protection accessory 110 for assembly with a protective helmet 100, such as that illustrated in FIG. 1, to protect a wearer 300 during a cut-off tool kickback event. The face protection accessory 110 comprises a U-shaped supporting frame 115 extending between left and right temple anchoring points **120*l*, 120*r*, via left and right cheek-bone portions 130*l*, 130*r* arranged on either side of the U-shaped supporting frame 115, and a chin portion 140 arranged at a distal end of the accessory 110. This means that the U-shaped supporting frame 115 extends from a position on the side of the helmet downwards in direction of the y-axis to a point corresponding to the location of the chin of a wearer, as illustrated in FIG. 3. The U-shaped supporting frame 115 then extends transversally along the z-axis, before extending back along the y-axis to a point on the other side of the helmet, approximately at the location of the temple of a wearer. FIG. 2 schematically illustrates the U-shaped supporting frame 115 and its extension from one anchoring point 120***l* to the other anchoring point 120*r*. The chin portion 140 preferable extends in arcuate form substantially parallel to the base plane 101, at a distance from the chin of a wearer, as illustrated in FIG. 3. An example distance 330 measured along from the chin of the wearer to the chin portion 140 is indicated in FIG. 3. At least a first guard bar 150 extends transversal to the U-shaped supporting frame 115 between the left and the right cheek-bone portions 130*l*, 130*r*. This guard bar extends approximately in-between the mouth and the nose of a wearer, as shown in FIG. 3. When viewed from above (along the y-axis), the first guard bar 150 has an arcuate form and extends in a plane that is at least approximately parallel to the base plane 102. The first guard bar 150 extends out from the U-shaped supporting frame 115 in vicinity of the cheek-bone portion and then curves back to the corresponding place on the other side of the U-shaped supporting frame 115, forming a guard against impact from, e.g., a cutting blade.

The first guard bar 150 is preferably a metal guard bar having a cross section diameter of at least 2 mm, and preferably between 3-6 mm or 4-6 mm. Generally, the larger the diameter the stronger the guard bar. A 5 mm diameter guard bar has been shown to yield satisfactory performance in terms of weight and ability to resist impact. A metal guard bar of these dimensions is likely able to withstand the impact energy of about 75 Joules which is to be expected from a cutting blade during a kickback event, at least for some types of cut-off tools and common cutting blade dimensions. The first guard bar 150 preferably extends away from the U-shaped supporting frame 115, in the direction of the x-axis as shown in FIG. 1 and in FIG. 3, such that an extreme point 151 of the first guard bar 150 in the x-direction extends beyond a plane 320 extending in the z-direction orthogonal to the base plane 101 and intersecting the dome shaped shell 102 of the helmet. In most embodiments, the first guard bar 150 extends away from the U-shaped supporting frame 115 such that the extreme point 151 of the first guard bar 150 extends beyond a plane 320 orthogonal to the base plane 101 and tangent to the brim portion 104 of the protective helmet 100. On some example helmets, the plane 320 is tangent to an extreme point of the front-most portion of the helmet, for instance a brim portion of the helmet. On other example helmets, the plane 320 is tangent to a brim portion of the face protection accessory, as in FIG. 3. The plane 320 is also distanced from a nose of the wearer 300 by a distance 335 when worn, which distance may be on the order of 3-5 cm.

Lacking a stable enough industrial safety helmet as base, it is proposed herein to let the face protection accessory engage the wearer's face during impact to gain support to withstand the kickback event impact. To ensure that the blade does not reach the face, the face protection accessory is preferably designed such that a long enough distance is provided between the actual protective members and the face of the person when the person is wearing the helmet, and at the same time be so close so that the protection's rotating motion does not bring it in under the chin of the wearer (exposing the face). I.e. when landing in the face of the wearer during a kickback event, the protection needs to have a sufficient depth to keep the blade from reaching the face.

It is also preferred that the face protection accessory does not rest in contact with the person wearing the helmet during normal usage since this would impact the user experience and cause general inconvenience. It is also preferred that the space between the face protection components and the wearer is sufficiently large to accommodate respiratory protection, such as a breathing filter or disposable respirator. The U-shaped supporting frame 115 is preferably configured to provide a spacing distance from the wearer 300 in direction of the z-axis to the left and right cheek-bone portions 130*l*, 130*r*, and preferably also to provide a spacing distance in direction of the x-axis from the wearer 300 to the chin portion 140. The spacing distance from the wearer to the left and right cheek-bone portions may be about 0.5-2 cm. The spacing distance from the wearer to the chin portion may be on the order of 1-5 cm, i.e., slightly larger compared to the spacing distance from the wearer to the left and right cheek-bone portions. Thus, the impact energy from a cutting blade will transfer to the U-shaped supporting frame 115 via the guard bar, and the U-shaped supporting frame 115 will then land on the face of the wearer, where the impact energy will be distributed over the face of the wearer which mitigates the consequences of the impact. The impact energy will also be at least in part absorbed by one or more shock absorbing elements 180 on the inside of the U-shaped supporting frame, which are visible in FIG. 1, and which will be discussed in more detail below. The one or more shock absorbing elements 180 are perhaps more clearly shown in FIG. 4B.

To further increase the mechanical strength of the face protection accessory 110, an optional guard bar support member 160 extends out from the chin portion 140 to support the first guard bar 150. This guard bar support member 160 also provides additional protection in vicinity of the mouth of the person wearing the helmet, which is an advantage. The guard bar support member also provides support for additional shock absorbing elements 180, which is an advantage.

Figure 10:
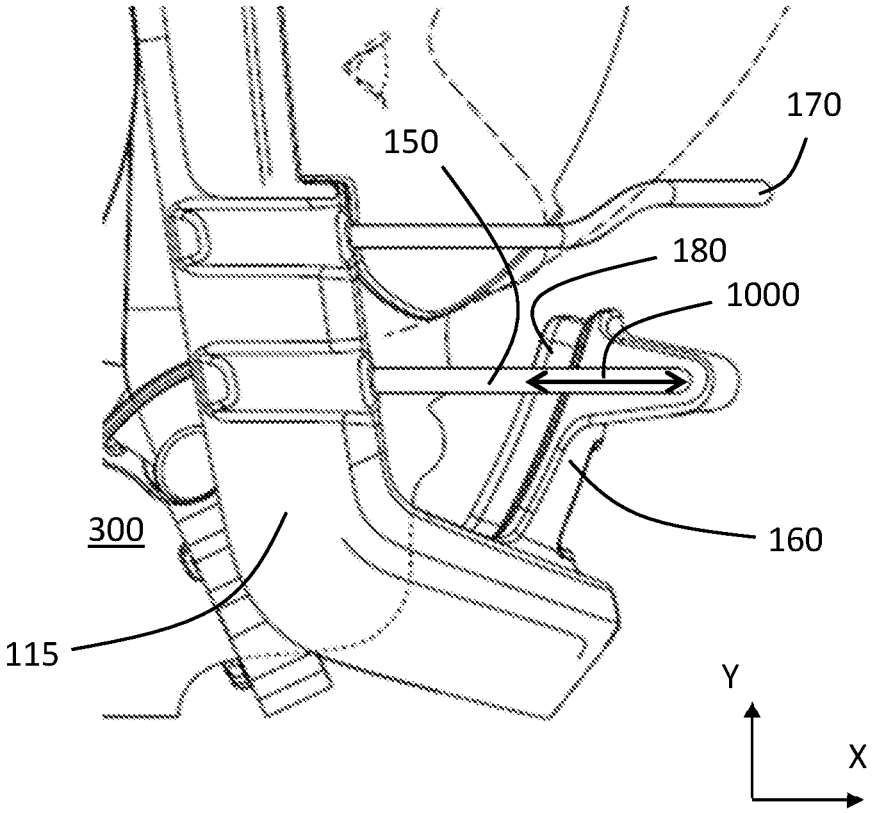
FIG. 10 illustrates details of an example face protection accessory.

FIG. 10 illustrates some optional details of the guard bar support member 160. The extreme point of the first guard bar 150 (the point furthest away from the face of the wearer 300) is separated by a distance 1000 from the shock absorbing element 180, and from the internal surface of the U-shaped supporting frame. The distance 1000 is here measured along the x-axis extension of the first guard bar 150. However, the distance can also be measured from the point on the first guard bar most distant from the face of the wearer to the closest shock absorbing element 180.

This spacing between the shock absorbing element 180 and the guard bar 150 acts like a form of deformation zone as the face protection accessory contacts the face of the wearer 300 during a kickback event. The distance 1000 may be on the order of 2-7 cm. In other words, the guard bar support member 160 is optionally arranged to support the first guard bar 150 at a distance 1000 from the internal surface of the U-shaped supporting frame 115 facing the wearer 300, wherein the distance 1000 is between 2-10 cm, and preferably between 3-5 cm. The U-shaped supporting frame portion of the face protection accessory 110 can be formed in a plastic material, such as a polymer. This polymer can be reinforced, e.g., by a glass fibre reinforcement structure or the like, although this is not strictly necessary for the face protection accessory to provide sufficient protection for a wearer during a kickback event. The U-shaped supporting frame 115 optionally also comprises attachment means for a chin strap, although it is appreciated that the chin straps can also be attached to the helmet independently from the face protection accessory.

The U-shaped supporting frame 115 may be integrally formed with the protective helmet, i.e., molded in one piece of plastic. The U-shaped supporting frame 115 may also be releasably attached to the helmet, as will be explained in the following.

An optional second guard bar 170 extends in alignment with and distanced from the first guard bar 150, transversal to the U-shaped supporting frame 115 between the left and the right cheek-bone portions 130*l*, 130*r*. This second guard bar 170 provides further protection for the face of the wearer. The second guard bar is preferably also made of metal, and preferably has a dimension similar to that of the first guard bar. The second guard bar 170 is optionally designed to cooperate with a pivotable visor supporting frame 190 which will be discussed in more detail below, such that the visor supporting frame can pivot freely past the second guard bar 170. This provides the advantage of allowing a wearer to remove the visor without removing the face protection, i.e., the guard bar or bars and the U-shaped supporting frame, which is an advantage.

The first guard bar 150 and/or the second guard bar 170 may be formed as over-molded steel rods arranged inserted into or otherwise anchored in the U-shaped supporting frame 115.

The face protection accessory 110 can be attached to the helmet in many ways. The accessory can for instance be configured for attachment directly to the helmet, e.g., by a fastening member extending through a hole formed in the helmet surface. Alternatively, the face protection accessory 110 can be arranged to interface with an existing attachment member on the helmet, e.g., by means of a snap-lock mechanism or the like.

Figure 6A:
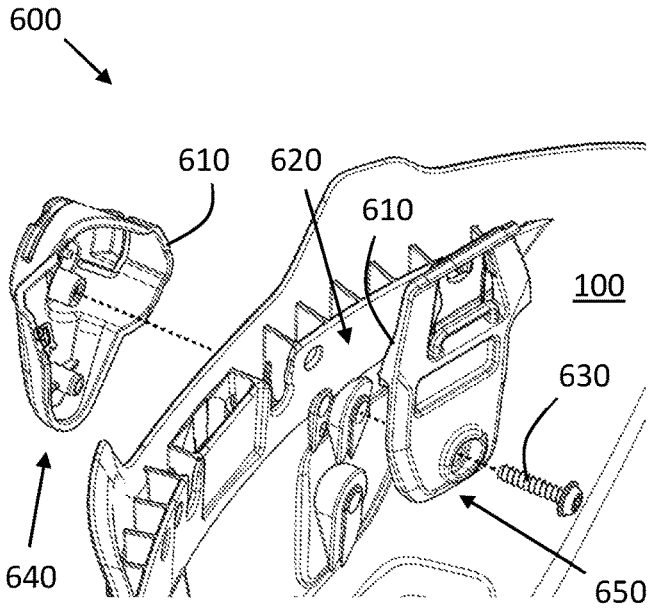
FIGS. 6A-B illustrates means for securing an accessory to a helmet.
Figure 6B:
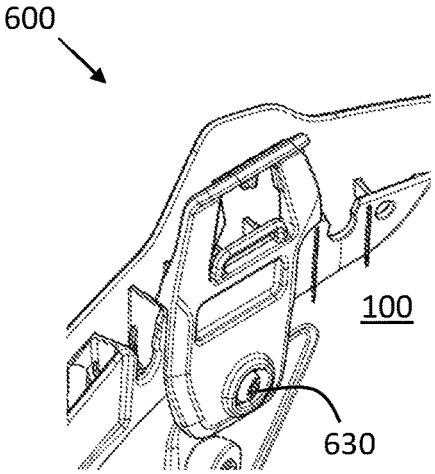

FIGS. 6A-B illustrate one such example attachment mechanism for attaching the face protection accessory 110 to the helmet at the left and right temple anchoring points 120*l*, 120*r*. In this example, an external member 640 engages an external surface of the helmet and an internal member 650 engages a corresponding internal surface 620 of the helmet. The two members 640, 650 are held in position by a fastening member 630 which extends through the helmet surface. This is an advantage since the face protection accessory 110 can be retro-fitted to an existing helmet simply by drilling a hole in a suitable location through the helmet shell. In the example, the left and right temple anchoring points 120*l*, 120*r* comprise or are arranged to interface with respective supporting surfaces 610 that are matched to corresponding supporting surfaces 620 of the protective helmet 100, and fastening members 630 arranged extending through the helmet, to fixedly secure the face protection accessory 110 to the protective helmet 100. The fastening members may, e.g., comprise rivets or threaded members, as shown in the example 600 of FIG. 6A. The fastening arrangement by which the left and right temple anchoring points 120*l*, 120*r* interface with the helmet structure is preferably of high mechanical strength, such that they can withstand a considerable amount of force which is to be expected during a kickback event. A metal bolt or rivet extending though the helmet shell provides the necessary strength. It is an advantage that the left and right temple anchoring points 120*l*, 120*r* and the fastening members 630 can be adapted to an existing protective helmet, i.e., the face protection accessories 110 discussed herein can be mounted onto existing helmets, without modification to the helmet, simply by forming suitable temple anchoring points 120*l*, 120*r* and attaching them to the helmet, for example by drilling a hole in the helmet shell and attaching the face protection accessory by a fastening member through the hole. The supporting surfaces 610 of the left and right temple anchoring points 120*l*, 120*r* are preferably arranged to engage respective supporting surfaces 620 of the protective helmet 100 on an interior surface of the helmet. In other words, the supporting surfaces 610 of the face protection accessory 110 can be adapted to a given model of protective helmet, in order to increase the mechanical strength of the connection between helmet shell and face protection accessory 110. In case the U-shaped supporting frame is arranged separable between the right temple anchoring points 120*l*, 120*r* and the cheek-bone portions 130*l*, 130*r*, then only the anchoring point part of the face protection accessory 110 needs to be adapted in order to fit a given type and model of protective helmet.

Based on the above discussion, it is understood that the face protection accessories 110 discussed herein may be attached to the protective helmet in many ways. According to one example the left and right temple anchoring points 120*l*, 120*r* of the face protection accessory 110 comprises the supporting surfaces 610 matched to corresponding supporting surfaces 620 of the protective helmet 100, and also the fastening members 630 arranged extending through the helmet, to fixedly secure the face protection accessory 110 to the protective helmet 100.

Figure 4A:
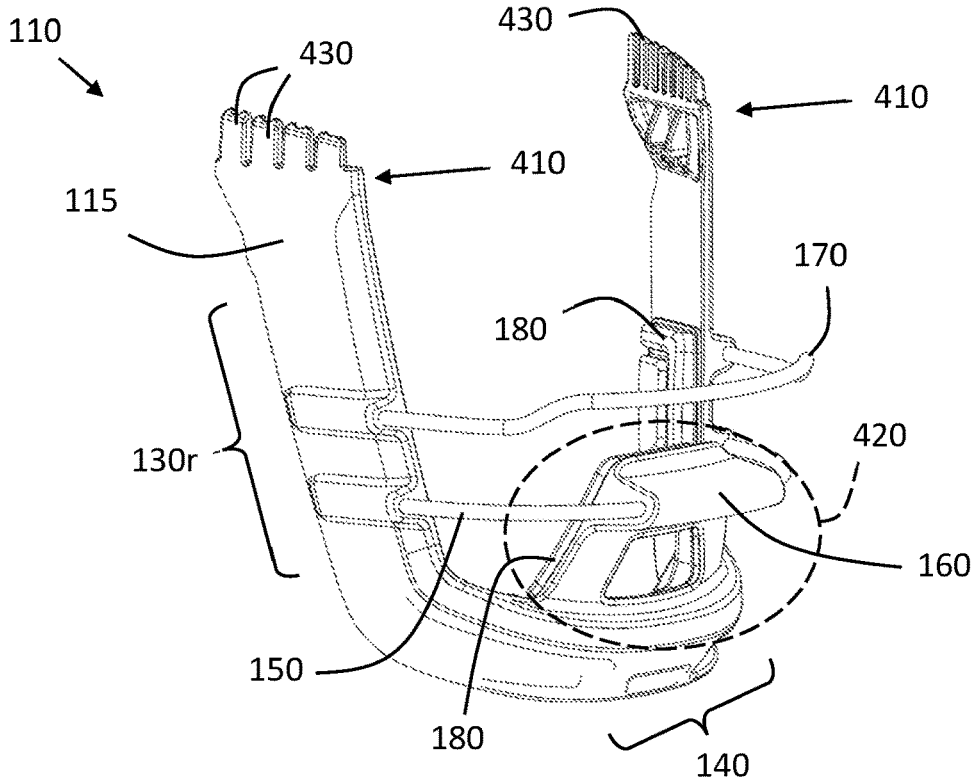
FIGS. 4A-B shows details of a face protection accessory.
Figure 4B:
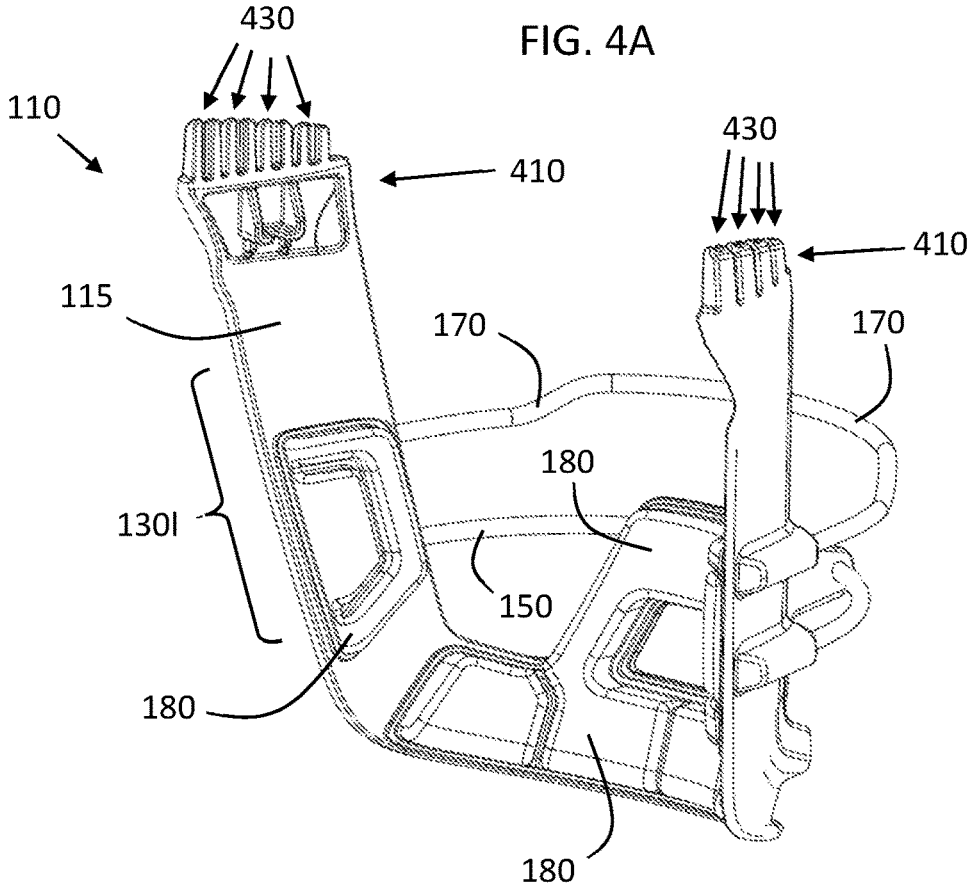

According to another example, the left and right temple anchoring points 120*l*, 120*r* of the face protection accessory 110 are arranged to interface with attachment means on the helmet, i.e., by means of an interference fit mechanism or snap-lock mechanism. In other words, the parts shown in FIG. 4A-B represent an embodiment of the face protection mechanism 110, where the left and right temple anchoring points 120*l*, 120*r* comprise snap-lock mechanisms configured to mate with corresponding mechanisms on the protective helmet, for holding the face protection accessory 110 in position.

Thus, the actual attachment mechanism is not necessarily comprised in the face protection accessory 110 and the two may be marketed and sold separately.

The outboard part of the attachment mechanism 640 shown in FIG. 6A can be arranged to hold a visor supporting frame 190, while the inboard part of the attachment mechanism 650 can be configured to hold the U-shaped supporting frame 115. This is an advantage since the mechanical strength of the overall arrangement is increased, and at the same time separating the two parts such that the visor can be operated independently of the U-shaped supporting frame, which is an advantage.

With reference to FIG. 1, a part of the visor supporting frame 190 has a shape matched to the shape of the brim portion 104 of the protective helmet. A part of the visor supporting frame 190 may cover the brim portion 104 when the visor is in the down-folded position (the position indicated in FIG. 1). The visor supporting frame 190 then extends past the brim portion, to optionally form a more pronounced brim portion compared to when the visor supporting frame 190 is not used.

Figure 5A:
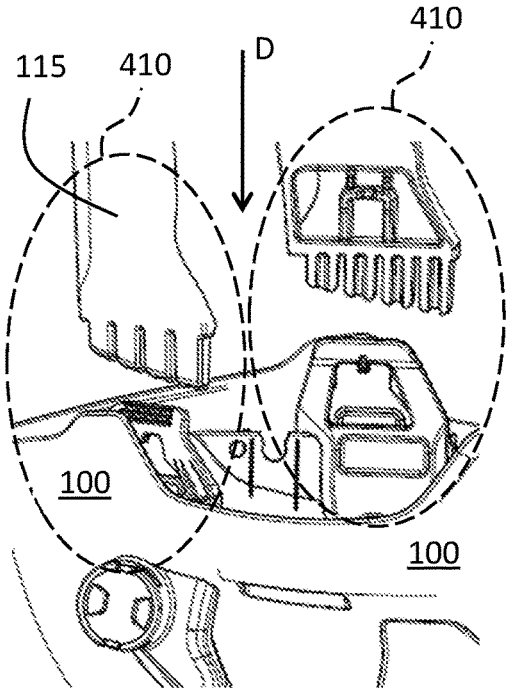
FIGS. 5A-B shows an example releasable attachment mechanism.
Figure 5B:
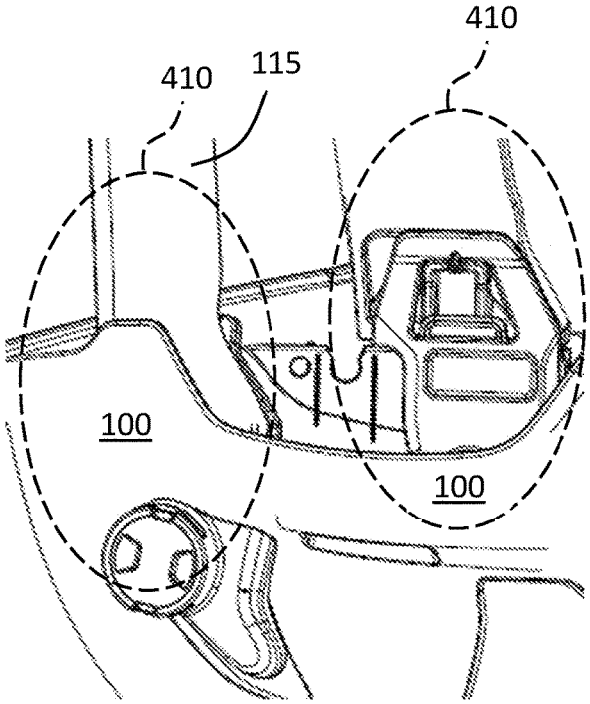

FIGS. 4A and 4B show an example U-shaped supporting frame 115 comprising the guard bars, which is configured to be releasably attached to the anchoring point attachment mechanisms 640, 650 which engage the helmet structure. FIGS. 5A and 5B illustrate example attachment means for connecting the parts in FIGS. 4A and 4B to the parts fixedly attached to the helmet structure. Thus, according to an example, the U-shaped supporting frame 115 is separable by means of releasable attachment mechanisms 410 arranged at a location between the cheek-bone portions 130*l*, 130*r* and the temple anchoring points 120*l*, 120*r* of the U-shaped supporting frame 115. The releasable attachment mechanisms 410 between the temple anchoring points 120*l*, 120*r* and respective left and right cheek-bone portions 130*l*, 130*r* may, e.g., comprise snap-lock mechanisms and/or interference fit mechanisms. One part of the accessory 110 is inserted in direction D into a receiving part, as illustrated in FIG. 5A. The connection can be configured releasable, which means that a user of the helmet can release the connection and remove the face protection accessory in a convenient manner.

The releasable attachment mechanisms 410 preferably comprises at least two teeth 430 separated by notches, arranged to mate with a reinforcement structure of the protective helmet shell. The teeth provide increased resistance to rotating motion about the attachment point.

Adding cushioning padding, or shock absorbing elements, on the inside of the face protection accessory, in front of the chin, to function as an energy absorber and buffer zone will achieve a distance from the blade during impact and helps to distribute the energy of the impact. However, given the great forces involved, there will still be a risk that the protection moves down below the chin. Extending the front portion of the protection 420 up in front of the mouth, also with cushion padding towards the face will further improve the energy absorption capability of the face protection accessory These elements are arranged on a surface of the U-shaped supporting frame 115 arranged to face the wearer 300. Thus, as the cutting blade impacts the face protection accessory 110, the U-shaped supporting frame 115 is pushed backwards to land onto the face of the person wearing the helmet, whereupon the shock absorbing elements 180 absorbs some of the impact energy, and also distributes the impact energy over the facial structure of the person wearing the helmet.

The shock absorbing elements 180 are advantageously formed in a resilient material, such as rubber, silicone, or some form of foam material suitable for absorbing impact energy. A structure arranged for deformation in response to an impact can also be used.

As shown in FIG. 4B, each cheek-bone portion 130*l*, 130*r* may comprise a respective resilient shock absorbing element 180 arranged on a side of the cheek-bone portion 130*l*, 130*r* configured to face the corresponding cheek bone of the wearer 300. Also, the chin portion 140 preferably comprises a shock absorbing element 180 on a side of the chin portion 140 configured to face the chin of the wearer 300. Notably, a space is formed in-between the shock absorbing elements 180 to promote ventilation.

Figure 7:
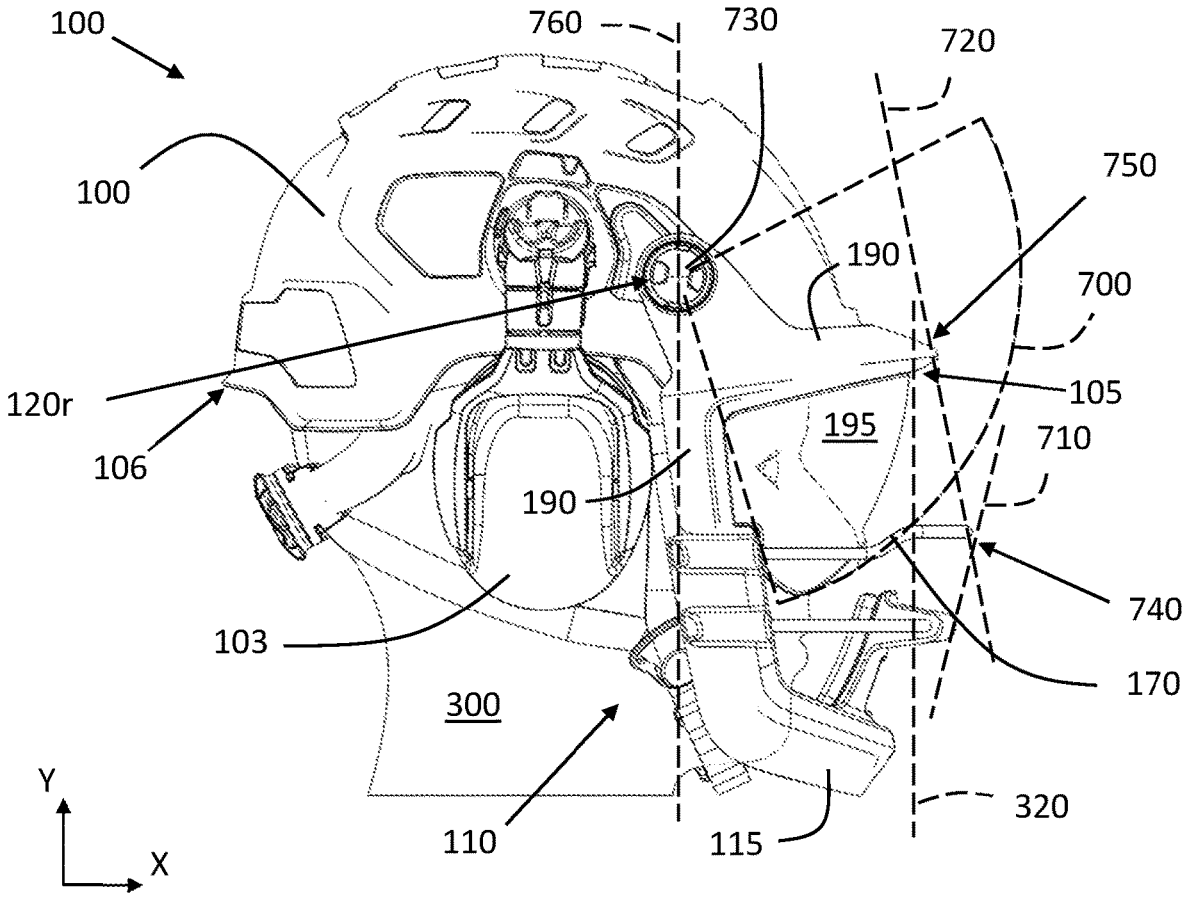
FIGS. 7-8 show protective helmets with face protection accessories.

Referring now to FIG. 7, which illustrates some details of the optional visor 195, which may comprise a lens or a mesh, and that can be used together with the face protection parts discussed above. The face protection accessory 110 optionally comprises a visor supporting frame 190 extending between the left and right temple anchoring points 120*l*, 120*r*. The visor supporting frame can be configured to hold the visor 195, i.e., a transparent shielding structure like a see-through plastic, polycarbonate (PC) or poly-methyl methacrylate (PMMA) screen (also known as acrylic, acrylic glass, Perspex, or plexiglass screen), or a fine mesh configured to protect the wearer from spray and dust. The example visor supporting frame 190 in FIG. 7 is arranged pivotably attached 730 to the U-shaped supporting frame 115 and/or to the protective helmet 100 and configured to pivot 700 about the temple anchoring points 120*l*, 120*r*. The visor supporting frame 190 is advantageously arranged outboard of the U-shaped supporting frame 115 with respect to the protective helmet 100 (outside of the U-shaped supporting frame seen from the wearer 300), which means that the visor can be pivoted away from the face of the wearer 300 without moving the other parts of the face protection accessory 110, which may then remain in fixed position. Thus, a user is less likely to remove the parts of the face protection accessory which protects the user from harmful impact during a kickback event, i.e., the U-shaped supporting frame 115 with the guard bar or guard bars), than he/she would be if removing the visor would also necessitate moving the U-shaped supporting frame 115 with the guard bars.

According to some aspects, the visor supporting frame 190 is arranged to pivot 700 in an arc past the first and/or second guard bar 150, 170. This means that the visor pivots in behind the guard bar or bars to a position closer to the face of the wearer 300 compared to the first and/or second guard bars 150, 170, where it is protected from being impacted by objects. Here, to be located behind a guard bar can be taken to mean that an extreme point of the visor 195 in the x-direction is closer to the wearer 300 compared to an extreme point of at least one of the guard bars 140, 170. Also, the visor is less likely to be scratched if the wearer places the helmet with the visor down on the ground, since the guard bars then protects the visor at least to some extent. Still, the visor assumes a position snug with the face of the wearer when in the downfolded position, which improves the protection obtained from the visor 195.

With reference to the illustration in FIG. 7, the visor 195 is arranged behind a plane 720 tangent to an extreme point 740 of the first guard bar 170 and tangent to an extreme point 750 of the visor supporting frame 190, when the visor is in a folded down position (where it protects the eyes of the wearer 300). Thus, an object striking the helmet is less likely to impact the visor screen arrangement, thereby protecting the visor screen from, e.g., scratch marks and the like It is particularly noted that the U-shaped supporting frame 115 has a portion with a shape complementary to the visor supporting frame 190, i.e., the U-shaped supporting frame 115 is arranged to mate with the visor supporting frame 190 when the visor is in a folded down position. This mating provides a seal to better protect the eyes of the wearer. For instance, the visor 195 may be configured to fit snugly against the U-shaped supporting frame, and against the brim of the helmet, such that no significant amount of dust and slurry can enter in behind the visor to cause discomfort to the wearer. It is also reiterated that it is an advantage that the visor supporting frame 190 is arranged to be pivotably attached 730 to an exterior surface of the protective helmet 100, and not on the inside of the helmet surface where the U-shaped supporting frame is attached. This means that the visor can be folded up, i.e., moved from the folded position, without moving the facial protection structure.

It is realized that the visor parts 190, 195 can be used independently from the kick-back protection parts, i.e., the U-shaped supporting frame 115 that comprises the guard bars 150, 170. Thus, there is also disclosed herein a face protection accessory 110 for assembly with a protective helmet 100 to protect a wearer 300 during construction work, comprising a visor supporting frame 190 extending between a left a right temple anchoring point 120*l*, 120*r*, wherein the left and right temple anchoring points 120*l*, 120*r* comprise or are arranged to interface with respective supporting surfaces 610 matched to corresponding supporting surfaces 620 of the protective helmet 100, and fastening members 630 arranged extending through the helmet, to fixedly secure the face protection accessory 110 to the protective helmet 100.

FIG. 7 also illustrates some advantageous features of a protective helmet 100 which can be used independently of the other features discussed herein. For instance, it is an advantage that the visor part of the face protection accessory is arranged pivotable while the U-shaped supporting frame 115 with the guard bars 150, 170 is fixed, since this way a wearer can easily remove the visor 195 without also removing the guard bars 150, 170. In other words, FIG. 7 illustrates an example face protection accessory 110 for assembly with a protective helmet 100 to protect a wearer 300 during construction work. The face protection accessory 110 comprises a visor supporting frame 190 and a U-shaped supporting frame 115 extending between a left and a right temple anchoring point 120*l*, 120*r*. The visor supporting frame 190 is pivotably attached 700 to the protective helmet 100 at the temple anchoring points 120*l*, 120*r*, and the U-shaped supporting frame 115 is arranged to be fixedly attached to the protective helmet 100 at the temple anchoring points 120*l*, 120*r*.

FIG. 7 also shows a protective helmet 100 arranged to protect a wearer 300 during construction work. The helmet 100 comprises a visor supporting frame 190 supporting a visor 195 and/or a U-shaped supporting frame 115 supporting one or more guard bars 150, 170. The visor supporting frame 190 and/or the U-shaped supporting frame 115 extends between a left and a right temple anchoring point 120*l*, 120*r*. A separating plane 760 normal to the base plane intersects the left and the right temple anchoring point 120*l*, 120*r*, and the helmet 100 further comprises attachment means for attaching hearing protection 103, where the attachment means for attaching hearing protection 103 is separated from the visor 195 and/or from the one or more guard bars 150, 170 by the separating plane 760. This way the hearing protection, i.e., the ear-muffs or similar, can be operated independently from the pivoting of the visor, which is an advantage.

Figure 8:
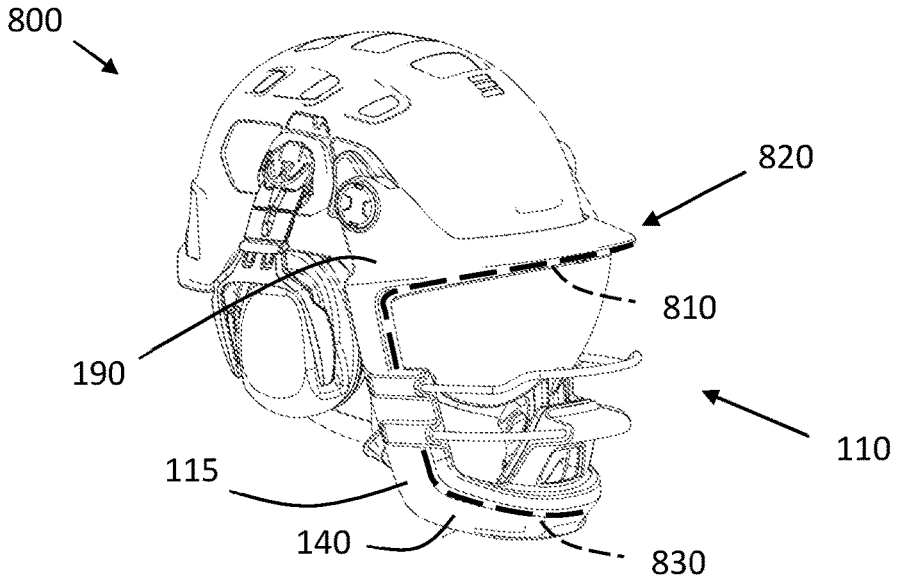

FIG. 8 illustrates an example 800 of a face protection accessory 110 where the brim section 820 of the visor part and the chin portion of the U-shaped supporting frame has been reinforced. The two reinforcements can of course be applied independently of each other.

The visor supporting frame 190 in the example 800 comprises a first reinforcement structure 810 configured in connection to a brim section 820 of the visor supporting frame. This reinforcement can, e.g., comprise steel bar embedded into or attached to the brim section 820 of the visor supporting frame 190 similar to the guard bars 150, 170, or some other form of reinforcement which increases the strength of the brim portion 820, allowing it to provide increased protection against impact from a cutting blade during a kickback event.

The brim portion 820 of the visor supporting frame 190 is preferably configured with a shape that mates with a brim portion of the protective helmet, e.g., a brim portion of a helmet, such that a part of the impact energy is transferred via the brim portion 820 to the helmet during a kickback event.

The U-shaped supporting frame 115 optionally comprises a second reinforcement structure 830 configured in connection to the chin portion 140 of the U-shaped supporting frame. This second reinforcement structure 830 may also comprise a steel bar embedded into or attached outboard of the chin portion 140 of the U-shaped supporting frame.

Figure 9A:
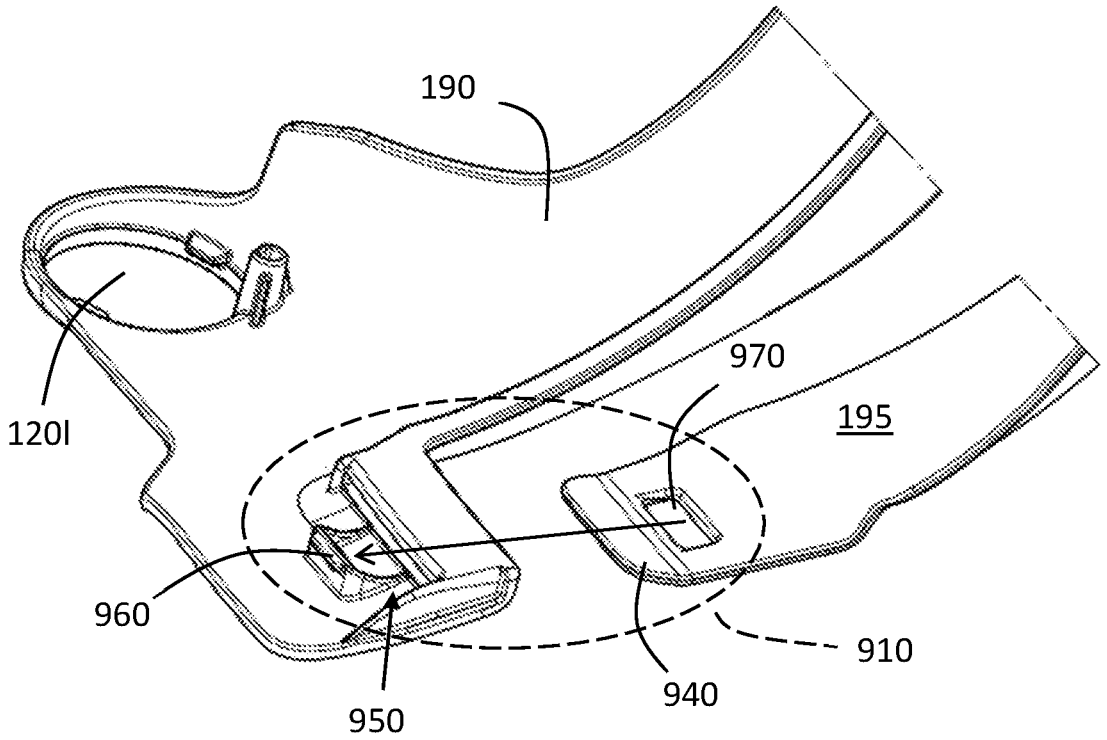
FIGS. 9A-B illustrate details of a visor face protection.
Figure 9B:
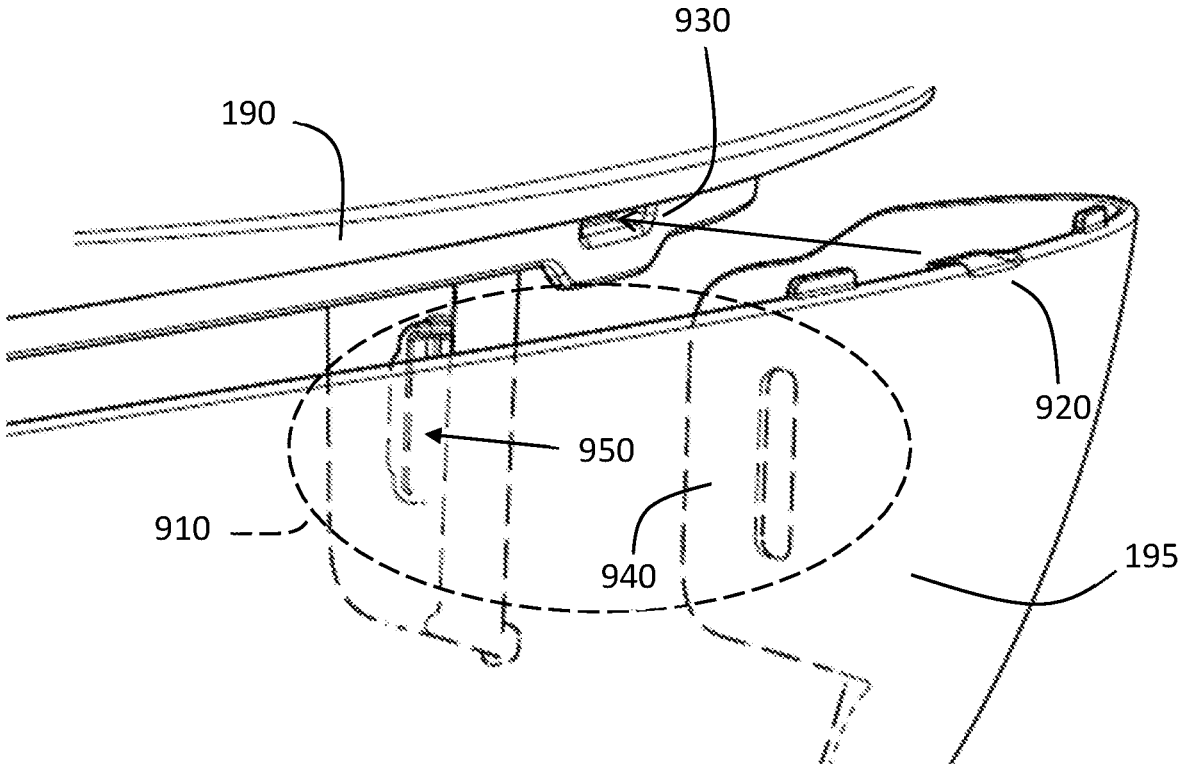

FIGS. 9A and 9B illustrate a particularly convenient mechanism for attaching a visor 195 to the visor supporting frame 190. The visor supporting frame 190 is here arranged to receive the visor 195, and to releasably hold the visor in position by first and second snap-lock mechanisms 910 and/or interference fit mechanisms on either side of the visor 195. This means that a wearer can replace the visor if the visor gets worn, or if the wearer desired another form of visor. Perhaps a visor having a sub-screen effect, or a mesh-type visor which has better ventilation properties compared to, e.g., a PMMA-type visor. The example in FIG. 9B also comprises an optional central guiding member 920, 930 comprising a protrusion and a matching recess configured to receive the protrusion in guiding position, in order to better hold the visor 195 in position relative to the visor supporting frame 190.

The visor supporting frame 190 is here arranged to at least partly enclose the visor 195. In the example of FIGS. 9A-B, this means that a tab portion 940 of the visor 195 is arranged to be inserted into a receiving slot 950 formed in the visor supporting frame 195. This means that a seal if formed between the visor 195 and the visor supporting frame 190 through which dust is prevented from entering, and the arrangement also forms a strong bond between visor and visor supporting frame, which is nevertheless easy to release by operating the snap-lock mechanism.

The snap-lock mechanisms 910 comprise a protrusion 960 formed on an internal surface of the visor supporting frame 190 facing the wearer 300, with a matching hole 970 formed in the visor 195 for engaging the protrusion in locking position. It is an advantage to place the protrusion in this manner since the visor 195 is likely to strive for extending itself from the arcuate position into a straight position. A protrusion 960 formed in this manner will resist this straightening. This also brings an advantageous effect in that the part with the matching hole 970 will press against the part with the protrusions 960, thereby keeping the visor 195 in place and preventing inadvertent or accidental removal of the visor 195, which is an advantage. Generally, the visor attachment mechanisms discussed herein are able to withstand the vibration and impacts common on a construction site without coming loose.

The invention claimed is:

1. A face protection accessory of a protective helmet arranged to protect a wearer during construction work, the face protection accessory comprising:

a visor;

a visor supporting frame arranged to hold the visor; and a U-shaped supporting frame, wherein the U-shaped supporting frame comprising a left temple anchoring point, a right anchoring temple point, a chin portion arranged at a distal end of the face protection accessory, a left cheek-bone portion and a right cheek-bone portion, the left and right cheek-bone portions being arranged between the chin portion and the left and right temple anchoring points, respectively, wherein at least a first guard bar is arranged to protect the wearer in case of a kickback event and extends between the left and right cheek-bone portions transversal to the U-shaped supporting frame, wherein the first guard bar is positioned in use to extend at a height between positions of a mouth and a nose of the wearer, wherein the U-shaped supporting frame is arranged to be fixedly attached to the protective helmet, wherein the visor supporting frame is arranged to be pivotably attached to the protective helmet outboard of the U-shaped supporting frame, wherein supporting surfaces of the left and right temple anchoring points are arranged to engage respective supporting surfaces of the protective helmet on an interior surface of the helmet, and wherein the U-shaped supporting frame is separable via releasable attachment mechanisms arranged at a location between the right and left cheek-bone portions and the left and right temple anchoring points of the U-shaped supporting frame.

2. The face protection accessory according to claim 1, wherein the left and right temple anchoring points comprise respective supporting surfaces matched to corresponding supporting surfaces of the protective helmet, wherein fastening members extending through the helmet, are arranged to fixedly secure the face protection accessory to the protective helmet.

3. The face protection accessory according to claim 1, where a base plane of the protective helmet extends from a lower edge of a brim portion of the protective helmet to a lower edge of a rear portion of the protective helmet in use, wherein a normal to the base plane intersects an apex of a dome-shaped shell of the protective helmet, wherein the left and right temple anchoring points are separated from the chin portion by the base plane.

4. The face protection accessory according to claim 1, wherein one or more shock absorbing elements made of resilient material are arranged on a surface of the U-shaped supporting frame arranged to face the wearer.

5. The face protection accessory according to claim 1, where each of the right and left cheek-bone portions comprises a respective resilient shock absorbing element arranged on a side of the left and right cheek-bone portions configured to face a corresponding cheek bone of the wearer.

6. The face protection accessory according to claim 1, wherein the protective helmet extends in a dome shape from a base plane of the protective helmet, wherein the first guard bar extends away from the U-shaped supporting frame such that an extreme point of the first guard bar extends beyond a plane orthogonal to the base plane and tangent to a brim portion of the protective helmet.

7. The face protection accessory according to claim 1, wherein the chin portion comprises a shock absorbing element on a side of the chin portion configured to face the chin of the wearer.

8. The face protection accessory according to claim 1, wherein the releasable attachment mechanisms comprise snap-lock mechanisms.

9. The face protection accessory according to claim 1, wherein the releasable attachment mechanisms comprise at least two teeth separated by notches or an interference fit mechanism.

10. A face protection accessory of a protective helmet to protect a wearer during a cut-off tool kickback event, the face protection accessory comprising:

a U-shaped supporting frame extending between a left temple anchoring point and a right temple anchoring point, via a left cheek-bone portion and a right cheek-bone portion arranged on either side of the U-shaped supporting frame; and a chin portion arranged at a distal end of the face protection accessory, wherein the left and right temple anchoring points are configured for attachment to the protective helmet, and wherein at least a first guard bar extends transversal to the U-shaped supporting frame between the left and the right cheek-bone portions, wherein the left and right temple anchoring points comprise respective supporting surfaces matched to corresponding supporting surfaces of the protective helmet, wherein fastening members extending through the helmet, and are arranged to fixedly secure the face protection accessory to the protective helmet, wherein the face protection accessory further comprises a visor supporting frame extending between the left and right temple anchoring points, and wherein the visor supporting frame is arranged pivotably attached to the U-shaped supporting frame or to the protective helmet and configured to pivot about the left and right temple anchoring points while the U-shaped supporting frame remains fixed.

11. The face protection accessory according to claim 10, wherein the U-shaped supporting frame is formed in a plastic material or wherein the U-shaped supporting frame comprises attachment means for a chin strap.

12. The face protection accessory according to claim 10, wherein the first guard bar is an over-molded steel rod arranged inserted into the U-shaped supporting frame.

13. The face protection accessory according to claim 10, wherein the visor supporting frame is arranged outboard of the U-shaped supporting frame with respect to the protective helmet.

14. The face protection accessory according to claim 10, wherein the visor supporting frame is arranged to pivot in an arc past the first guard bar.

15. The face protection accessory according to claim 10, wherein the visor is arranged behind a plane tangent to an extreme point of the first guard bar and tangent to an extreme point of the visor supporting frame, when in a folded down position.

16. A protective helmet comprising the face protection accessory according to claim 10.

17. A face protection accessory for assembly with of a protective helmet to protect a wearer during a cut-off tool kickback event, the face protection accessory comprising:

a U-shaped supporting frame extending between a left temple anchoring point and a right temple anchoring point, via a left cheek-bone portion and a right cheek-bone portion arranged on either side of the U-shaped supporting frame; and a chin portion arranged at a distal end of the face protection accessory, wherein the left and right temple anchoring points are configured for attachment to the protective helmet, wherein at least a first guard bar extends transversal to the U-shaped supporting frame between the left and the right cheek-bone portions, wherein the left and right temple anchoring points comprise respective supporting surfaces matched to corresponding supporting surfaces of the protective helmet, wherein fastening members extending through the helmet, and are arranged to fixedly secure the face protection accessory to the protective helmet, wherein the face protection accessory further comprises a visor supporting frame extending between the left and right temple anchoring points, wherein the visor supporting frame is arranged pivotably attached to the U-shaped supporting frame or to the protective helmet and configured to pivot about the left and right temple anchoring points while the U-shaped supporting frame remains fixed, and wherein the visor supporting frame is arranged to pivot in an arc past the first guard bar.

* * * * *